United States Patent [19]

Petitto et al.

[11] Patent Number: 4,995,783

[45] Date of Patent: Feb. 26, 1991

[54] MATERIAL HANDLING PLATFORM FOR MATERIAL TRANSPORT VEHICLE

[75] Inventors: Angelo S. Petitto; Angelo A. Petitto; James L. Petitto; George W. Marshall, all of Morgantown, W. Va.

[73] Assignee: Petitto Mine Equipment, Inc., Morgantown, W. Va.

[21] Appl. No.: 385,695

[22] Filed: Jul. 26, 1989

[51] Int. Cl.[5] ..... B65G 7/00

[52] U.S. Cl. ..... 414/786; 405/291; 414/10; 414/495; 414/494; 414/642; 414/569

[58] Field of Search ..... 414/10, 11, 786, 494, 414/495, 642, 569; 405/146, 150, 151, 284, 291

[56] References Cited

U.S. PATENT DOCUMENTS

| | | | |
|---|---|---|---|
| 2,895,299 | 7/1959 | Washabaugh | 405/151 X |
| 3,409,158 | 11/1968 | Lull | 414/11 X |
| 3,625,504 | 12/1971 | Walker | 414/10 |
| 3,923,167 | 12/1975 | Blankenbeckler | 414/11 |
| 3,954,189 | 5/1976 | Sherritt | 14/11 |
| 4,455,118 | 6/1984 | Scharf | 414/559 X |
| 4,682,926 | 7/1987 | Chambers | 414/11 |

*Primary Examiner*—Robert J. Spar
*Assistant Examiner*—Craig Slavin
*Attorney, Agent, or Firm*—Stanley J. Price, Jr.

[57] ABSTRACT

A material handling platform is pivotally attached to the front of the material transport vehicle. Actuator means raise and lower the platform. The platform is arranged to tilt relative to the vehicle about a horizontal pivot at the front of the vehicle. A turntable is mounted on the platform. The material handling platform positions roof supports in an underground mine adjacent a long wall mining machine. The roof supports are transported by the material transport vehicle carrying the material handling platform with the longest dimension of the roof support aligned with the longitudinal axis of the vehicle. After the roof support reaches the position where it is to be installed, the roof support is turned relative to the vehicle by turning the turntable of the material handling platform so that the longest dimension of the roof support is at right angles to the longitudinal axis of the vehicle. The roof support is then removed from the vehicle by lowering and tilting the platform relative to the vehicle.

2 Claims, 3 Drawing Sheets

MATERIAL HANDLING PLATFORM FOR MATERIAL TRANSPORT VEHICLE

BACKGROUND OF THE INVENTION

1. Field Of The Invention

This invention relates to a material handling platform that may be installed on a material transport vehicle for carrying material on the platform and for rotating material relative to the longitudinal axis of the material transport vehicle. The material handling platform is particularly adapted for use in underground mining operations but the platform has applications other than for underground mining.

2. Description Of The Prior Art

Various types of vehicles have been provided with turntables on the vehicles for one purpose or another. U.S. Pat. No. 4,553,893 discloses a rotary turntable that may be placed in a production line to move the products to various locations.

U.S. Pat. No. 1,966,866 discloses a vehicle on endless tracks which has a turntable onto which a cement mixer may be driven. The turntable can be turned to permit the cement mixer to discharge cement to the sides of the vehicle.

U.S. Pat. Nos. 1,349,012 and 1,663,832 also show vehicles having turntables which may be utilized in paving and roadbed construction. U.S. Pat. No. 817,434 and U.S. Pat. No. 3,583,328 disclose turntables mounted on railway type vehicles. U.S. Pat. No. 3,830,385 discloses a baggage cart which has a turntable mounted on its top surface. U.S. Pat. No. 2,572,776, U.S. Pat. No. 3,190,475, U.S. Pat. No. 1,384,077 and U.S. Reissue Pat. No. 15,976 all show various types of portable turntables on vehicles.

None of the foregoing prior art shows a platform having a turntable wherein the platform may be both raised and lowered and also tilted and which may be readily secured to or removed from a material transport vehicle as the requirements of a particular job may require.

SUMMARY OF THE INVENTION

In accordance with the present invention, there is provided a material handling platform for a material transport vehicle wherein the platform has a forwardly extending base member with a top surface and a lower surface that is movably connected to a tilt frame so that the base member can be moved vertically relative to the tilt frame between a position at ground level and various positions substantially above ground level. First actuating means are connected to the base member and the tilt frame to move the base member vertically relative to the tilt frame upon actuation of the first actuating means and to maintain base member in a fixed position relative to the tilt frame when not actuated. A horizontal pivot is fixed to the material transport vehicle and the tilt frame is pivotally secured to the vehicle pivot means. A second actuating means connected to the vehicle and to the tilt frame pivots the tilt frame relative to the vehicle about the horizontal pivot means upon actuation of a second actuating means and maintains the tilt frame in a fixed position and relative to the vehicle when not actuated. A turntable which forms a portion of the area of the top surface of the base member is rotatably supported by the base member for movement with the base member and for rotation relative to the base member. A third actuating means is connected to the turntable and to the base member to turn the turntable relative to the base member when actuated and to maintain the turntable in a fixed position relative to the base member when not actuated.

Further, in accordance with the present invention, a material handling platform for a material transport vehicle is provided which has a forwardly extending base member that has a material handling top surface movably connected to a tilt frame. The base member may be moved vertically relative to the tilt frame between a position at ground level and positions substantially above ground level. A first actuating means which includes a double action hydraulic piston and cylinder is connected to the base member and to the tilt frame to move the base member vertically relative to the tilt frame upon actuation of the first actuating means and to maintain the base member in a fixed position relative to the tilt frame when not actuated. A horizontal pivot means is fixed to the front end of the vehicle to pivotally receive the tilt frame. A second actuating means, including a double action hydraulic piston and cylinder, is connected to the vehicle and to the tilt frame to pivot the tilt frame relative to the vehicle about the horizontal pivot means upon actuation of the second actuating means and to maintain the tilt frame in a fixed position relative to the vehicle when not actuated. A turntable forming more than fifty percent (50%) of the area of the material handling top surface of the base member is provided with the turntable being rotatably supported by the base member for movement with the base member and for rotation relative to the base member. A third actuating means, including a double action rotary vane hydraulic motor is connected to the turntable and to the base member to turn the turntable relative to the base member when actuated and to maintain the turntable in a fixed position relative to the base member when not actuated. A source of fluid under pressure is located on the material transport vehicle and hydraulic control lines and valves connect the hydraulic fluid source with the first actuating means, with the second actuating means, and with the third actuating means so that the actuating means may be selectively actuated to control the position of the base member and the turntable.

Still further in accordance with the present invention, there is provided a method of placing an additional roof support in position adjacent the long wall of an underground mine. The method includes placing a roof support to be transported on the material handling platform of a material transport vehicle having a device that enables the load on the platform to be rotated relative to the longitudinal axis of the vehicle. The roof support is rotated so that the longest dimension of the roof support is aligned with the longitudinal axis of the vehicle and the vehicle is moved along the long wall to the position where the transported roof support is to be placed. The roof support is then rotated on the material handling platform 90° so that the longest dimension of the roof support is at a right angle to the vehicle longitudinal axis and thereafter the transported roof support is removed from the vehicle material handling platform onto the floor of the underground mine.

Accordingly, a principal object of the present invention is to provide a material handling platform for a material transport vehicle which has a rotatable turntable on the top surface of the platform and wherein the platform may be lifted vertically relative to the vehicle and may be tilted relative to the vehicle.

Another object of the present invention is to provide a material handling platform for a material transport vehicle that may be readily controlled to perform a variety of tasks.

A further object of the present invention is to provide a method of placing an additional roof support in position adjacent to the long wall of an underground mine in an efficient manner.

These and other objects of the present invention will become apparent as this description proceeds in conjunction with the accompanying drawings and appended claims.

DESCRIPTION OF THE PREFERRED EMBODIMENT

Figure 1:
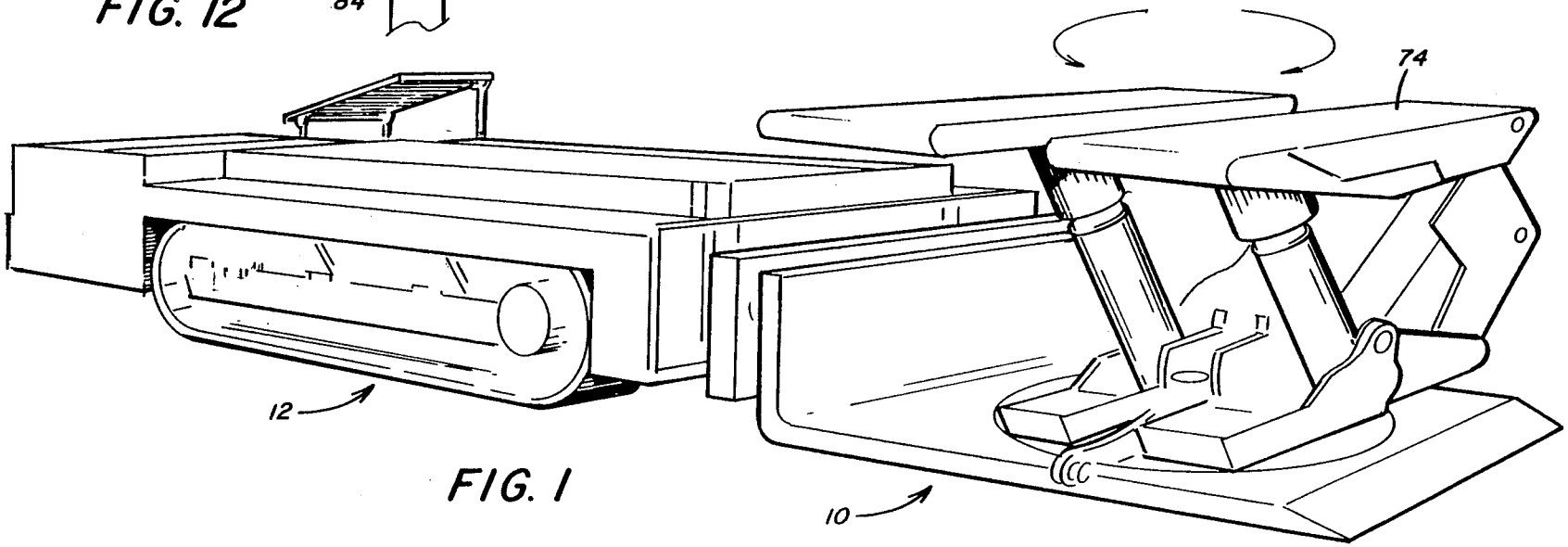
FIG. 1 is a perspective view of the material handling platform of the present invention in position on a material transport vehicle.

Referring to the drawings, and particularly to FIG. 1, there is shown a perspective view of a material handling platform indicated generally by the numeral 10 which is affixed to and carried by a material transport vehicle indicated generally by the numeral 12. The material transport vehicle 12 is preferably the type of vehicle disclosed in U.S. Pat. No. 4,199,299 and U.S. Pat. No. 4,411,583, both of which are assigned to the assignee herein. It should be understood that the vehicle disclosed in the aforesaid patents. is the preferred type of material transport vehicle 12 but that the material handling platform 10 of the present invention may be utilized with equal facility on other types of material transport vehicles such as back hoes, front end loaders, tractors and general utility vehicles. When utilized with the vehicles disclosed in U.S. Pat. No. 4,199,299 and U.S. Pat. No. 4,411,583, the material handling platform 10 is attached directly to the vehicle body and the boom arrangement shown in the aforesaid U.S. patents is removed from the vehicle body prior to installation of the material handling platform 10 of the present invention.

Figures 2, 3, 4, 10:
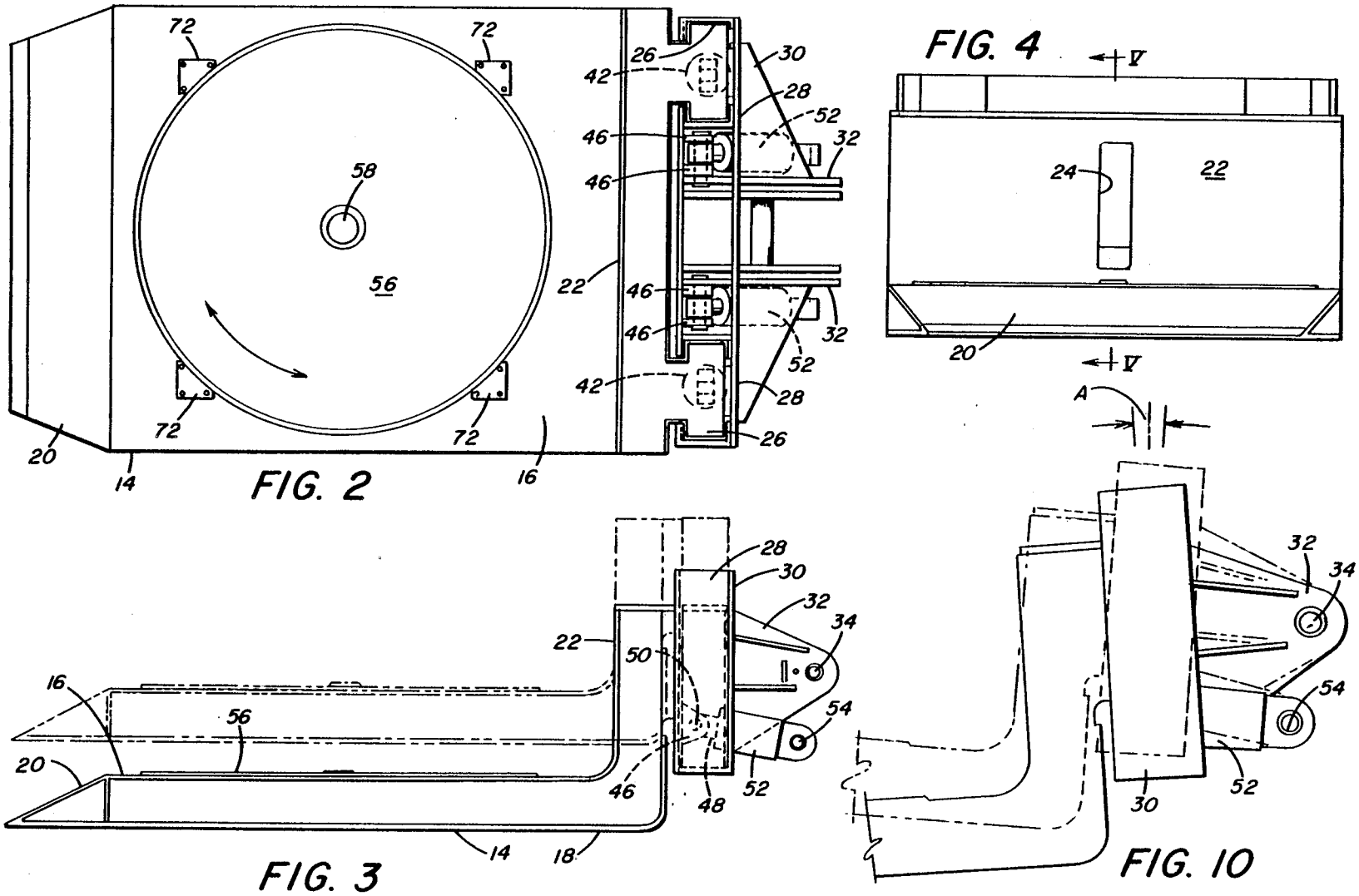
FIG. 2 is a top plan view of the material handling platform.
FIG. 3 is a view in side elevation of the material handling platform of the present invention showing the platform in an elevated position in phantom lines.
FIG. 4 is an end elevation view of a material handling platform as viewed from the left side of FIG. 2.
FIG. 10 is a fragmentary diagrammatic illustration of the tilt mechanism of the present invention showing the material handling platform in different tilted positions.

Referring to FIGS. 2, 3 and 4, the material handling platform 10 is formed from a base member 14 having a top wall 16 and a bottom wall 18 that are generally parallel to each other. The top wall 16 has an angled end portion 20 which permits material to slide up onto the top wall 16 of the platform. The base member 14 also has a vertical upstanding wall 22 that exterts upwardly from base member 14. Wall 22 has a rectangular opening 24 formed therein so that a winch cable 100 may be passed through opening 24 from a winch on the vehicle 12.

Figure 5:
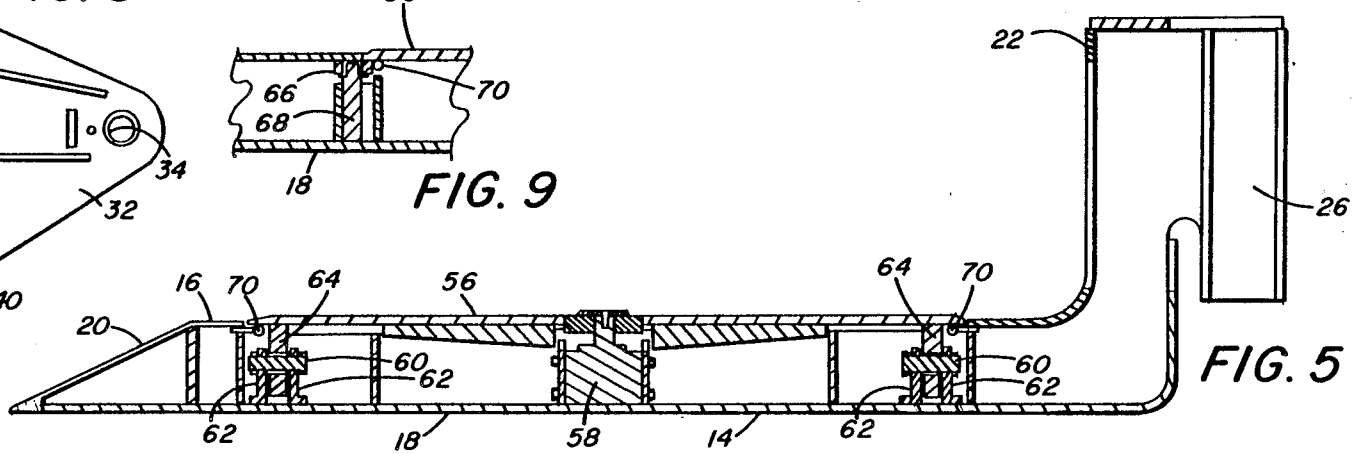
FIG. 5 is a sectional view of the base member of the material handling platform taken along line 5—5 of FIG. 4.
Figure 6:
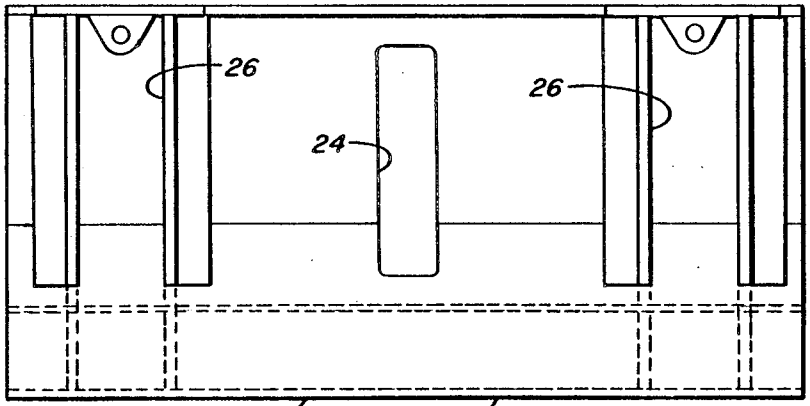
FIG. 6 is an elevational view of the base member as viewed from the right side of FIG. 5.

FIGS. 5 and 6 illustrate the base member 14 of the platform 10 in greater detail. As seen in FIGS. 2, 5 and 6 the base member 14 has a pair of guides 26 formed at the rear of upstanding vertical wall 22. The guides 26 guide the base member 14 for vertical movement relative to a pair of mating receiving guides 28 that are formed on tilt frame 30 (FIGS. 2 and 3).

As may best be seen in FIGS. 2, 3, 7 and 8, the tilt frame 30 slidingly receives guides 26 of base member 14 within receiving guides 28, respectively, so that base member 14 may be moved vertically relative to tilt frame 30. The tilt frame 30 has a pair of yokes 32 which extend to the rear of the tilt frame. The yokes 32 have pivot apertures or bores 34 formed therein to receive a pivot means (not shown) secured to the vehicle so that tilt frame 30 may pivot relative to the vehicle 12 about the pivot means that passes through pivot apertures 34 in yokes 32.

Figure 7:
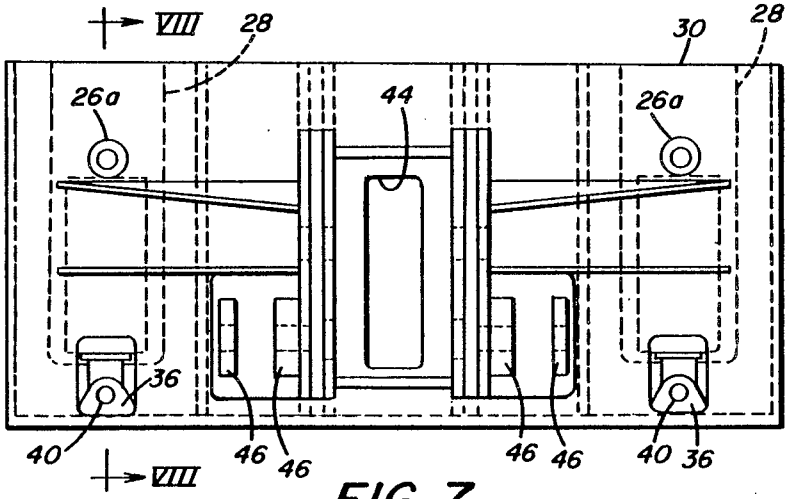
FIG. 7 is an elevational view of the material handling platform as viewed from the right side of FIG. 3 with certain parts removed for clarity.
Figure 8:
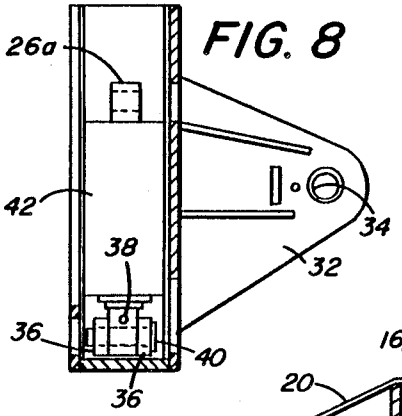
FIG. 8 is a sectional view taken along line 8—8 of FIG. 7 showing details of the lifting actuator for the material handling platform base member.

As best seen in FIGS. 7 and 8, a pair of piston brackets 36 are fixed to the tilt frame 30 within receiving guides 28. The pair of piston brackets 36 each receive a pin 40 that is attached to piston 38 of a piston-cylinder hydraulic actuator. The cylinder 42 of the hydraulic actuator is secured to a bracket **26*a* that is fixed to guides 26, as the case may be, that is part of base member 14. With such an arrangement, the double acting hydraulic actuator formed of piston 38 and cylinder 42 may raise and lower base member 14 relative to tilt frame 30 as illustrated in FIG. 3. With the double acting arrangement, the base member 14 may be stopped in any number of vertical positions relative to tilt frame 30 by closing all valves and trapping fluid at a specified level within the cylinder 42**.

As shown in FIG. 7, the tilt frame 30 has an elongated opening 44 formed to admit the winch cable 100 (shown in FIG. 1) through the tilt frame 30. The opening 44 in tilt frame 30 registers with opening 24 in vertical wall 22 of base member 14. Because of the elongation of the openings, the winch cable 100 may readily pass through both the base member 14 and tilt frame 30 without being pinched no matter what vertical position the base member 14 is in relative to tilt frame 30. The winch cable 100 may be attached to a load to be carried on the platform 10 and the load may be pulled onto platform 10 over inclined end 20 of the base member 14 by actuating the winch (not shown) on the vehicle 12.

As best seen in FIGS. 2, 3 and 7, the tilt frame 30 has brackets 46 formed thereon so that pistons 48 may be pinned by pins 50 to the brackets 46. The pistons 48 are part of a double acting piston-cylinder actuator which includes cylinder 52. Cylinder 52 has a bracket with an aperture 54 which attaches to a pivot means (not shown) that is fixed to the material transport vehicle 12.

As may be seen in FIG. 10, when the piston 48 and cylinder 52 are actuated they force the tilt frame 30 to pivot about pivot apertures 34 that are pivotally secured to vehicle 12. FIG. 10 shows, in phantom lines, an alternate position of the tilt frame 30. Shown in FIG. 10, tilt frame 30 may pivot about aperture 34 a total amount equal to angle A. In most cases, angle A will be a total of 12° so that the base number 14 may pivot 6° below the horizontal and 6° above the horizontal position shown in FIG. 3.

The piston 48 and cylinder 52 provide a double acting hydraulic piston-cylinder actuator which not only serves to tilt the tilt frame 30 relative to vehicle 12 but which also may fix the position of the tilt frame 30 relative to vehicle 12 while the piston 38 and cylinder 42 are not actuated.

As best seen in FIGS. 2 and 5, the top wall 16 of base member 14 has a turntable 56 positioned therein. Turntable 56 covers in excess of fifty percent (50%) of the total area of the top wall 16 of base member 14. The turntable 56 is supported by a center column 58 and by rollers 60 so that it may support heavy loads and be rotated relative to the base member 14 with the heavy weight thereon. The center column 58 is journaled for rotation relative to the base member 14. Rollers 60 are supported on brackets 62 fixed to base member 14. A circular flange 64 is fixed to the bottom of turntable 56 and extends around the periphery of turntable 56. Circular flange 64 rides upon the rollers 60 to support the weight of the turntable 56 and any material that is carried on turntable 56. As seen in FIGS. 3 and 5, the upper surface of turntable 56 extends above the top wall 16 of base member 14. A vane type hydraulic motor (not shown) is secured to center column 58 to rotate turntable 56 upon actuation of the hydraulic motor. The hydraulic motor is double acting so that it may be utilized to rotate the turntable in either direction and it may also be utilized to fix the turntable in a fixed position when the hydraulic motor is not actuated. The turntable 56 is constructed to rotate a total of 190° relative to base member 14.

Figure 9:
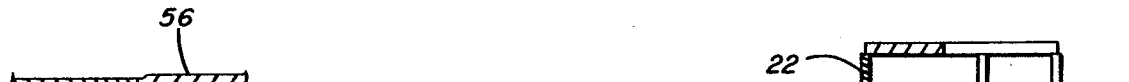
FIG. 9 is a fragmentary sectional view showing details of the horizontal rollers and the ring guide for the turntable.

The rollers 60 on brackets 62 are positioned in relatively closely spaced relation around the periphery of turntable 56. There are 12 sets of brackets 62 and rollers 60 to provide vertical support for the turntable, where desired, additional brackets 62 and rollers 60 may be utilized to provide additional support for the turntable 56. The turntable 56 is guided horizontally by horizontal rollers 66 that are rotatably journaled over posts 68 (FIG. 9). Posts 68 are fixed to bottom wall 18 of base member 14. A guide ring 70 is fixed to turntable 56 and rides against rollers 66 to maintain turntable 56 in proper horizontal position. There are four posts 68 and rollers 66 located around turntable 56. As seen in FIG. 2, access ports 72 provide access to rollers 66 through the top wall 16 of base member 14.

When positioned on a material transport vehicle 12, the material handling platform 10 of the present invention may be raised and lowered by actuating pistons 38 in cylinders 42 to raise and lower the base member 14 relative to the tilt frame 30 as shown in FIG. 3. When pistons 48 in cylinders 52 are actuated, the tilt frame may be pivoted about pivot aperture 34 relative to vehicle 12 through a total angle A as shown in FIG. 10. When the vane type motor actuator for turntable 56 is actuated, turntable 56 may be rotated through 190° relative to base member 14.

In the foregoing description, the actuators for the various elements of the material handling platform 10 have been described as hydraulic motor type actuators and hydraulic piston-cylinder type actuators. It will be appreciated that the actuators will have appropriate control lines and appropriate control valves to control the hydraulic fluid that actuates the various actuators. The control lines, control valves and actuators themselves are conventional units and form no part of the present invention. The control lines and control valves will pass through the operator's station located on the material handling transport vehicle so that the operator of the vehicle can control the various positions of the material handling platform. The typical material transport vehicle 12 will have a source of hydraulic fluid under pressure to operate the various actuators required for controlling the material handling platform 10.

While actuators for the positioning of the material handling platform 10 have been described as hydraulic type actuators, it will be appreciated that other types of actuators such as screw type actuators driven by electric motors could be substituted for piston-cylinder hydraulic type actuators and a worm gear drive powered by an electric motor could be utilized to drive the turntable of the present invention.

Figure 11:
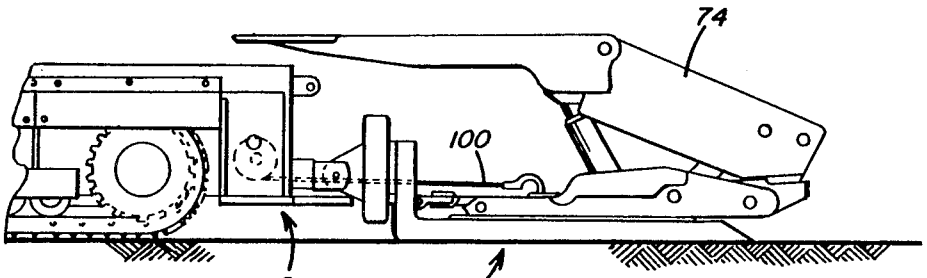
FIG. 11 is a side elevational view of the material handling platform of the present invention with a mine roof support being transported thereon.

The material handling platform of the present invention has many uses in material handling and haulage. It is particularly useful, however, when utilized to position roof supports in an underground mine that is using long wall mining apparatus. In long wall mining, a shear is moved along the face of the mineral being mined and dislodges the mineral from the face. The mineral is deposited upon a conveyer belt immediately behind the face and is removed from the mine in a direction parallel to the face. Typically, hydraulically controlled roof supports are positioned to protect the long wall machine and the conveyer arrangement from the roof which collapses behind the face as the face advances into the seam. As shown in FIGS. 1 and 11, a long wall roof support or jack 74 is carried on the material handling platform 10 of the present invention. In FIG. 11, the roof support is positioned on the platform 10 so that the long dimension of the roof support is aligned with the longitudinal axis of the material transport vehicle 12. In FIG. 1, the roof support 74 for illustrative purposes is illustrated as positioned on platform 10 so that the long dimension of the roof support is perpendicular or at 90° to the longitudinal axis of the material transport vehicle 12.

Figure 12:
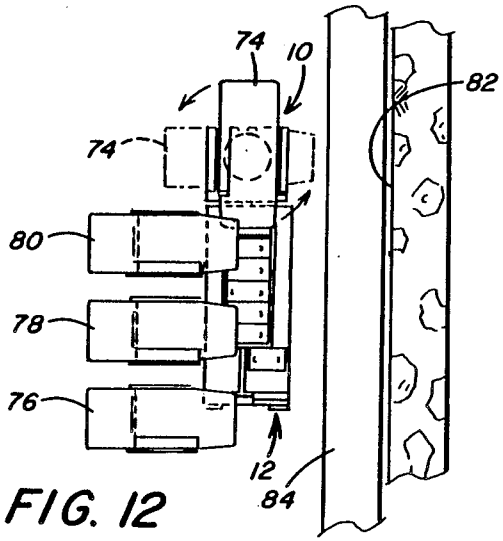
FIG. 12 is a fragmentary top plan view of an underground mine with a long wall mining machine therein showing the material handling platform of the present invention being utilized in placing the roof supports.

FIG. 12 is a diagrammatic illustration of a portion of a mine in which the mineral is dislodged by a long wall type mining machine. In FIG. 12, roof supports 76, 78 and 80 are in position at a short distance from the face 82. The conveyer 84 conveys mineral which is mined from the face to an entry located at the end of the mine.

The material transport vehicle 12 with the material handling platform 10 has an additional roof support 74 on the turntable of material handling platform 10. Ordinarily, the vehicle 12 is driven under the roof supports 76, 78 and 80 that are already in position within the mine. As the material transport vehicle 12 is moved under the existing roof supports, the new roof support 74 is positioned on turntable 56 of material platform 10 so that the long dimension of support 74 is aligned with the longitudinal axis of vehicle 12. The roof support 74 is carried with the base member 14 of material handling platform 10 raised from the ground while the vehicle is in motion and the base member 14 is not tilted but is parallel to the ground When the vehicle arrives at the place where roof support 74 is to be positioned, the turntable 56 of material handling platform 10 is rotated 90° so that the long dimension of the roof support 74 is at right angles to the longitudinal axis of vehicle 12. The base member 14 of material platform 10 is then tilted and lowered so that the front end of the base member 14 at the angled end 20 touches the ground. The roof support 74 is then slid from the material handling platform 10.

Prior to the use of the above-described method, it was difficult to position the roof support in its proper position within the long wall mining system since turning of the roof support was difficult. With the present method and the material handling platform of the present invention, placing a roof support within a long wall mine is greatly facilitated.

According to the provisions of the Patent Statutes, we have explained the principle, preferred construction and mode of operation of our invention and have illustrated and described what we now consider to represent its best embodiment. However, it should be understood that, within the scope of the appended claims, the invention may be practiced otherwise than as specifically illustrated and described.

We claim:

1. The method of placing an additional roof support in position adjacent a long wall type mining machine in an underground mine having a mine face comprising:

positioning a roof support to be transported on a substantially horizontal material handling platform of a material transport vehicle, said roof support positioned in a substantially horizontal position on said platform, said material handling platform having a turntable device that enables said roof support on said platform to be rotated horizontally on said platform relative to the longitudinal axis of said vehicle;

positioning said roof support on said platform so that the longest dimension of said roof support is aligned with the longitudinal axis of said vehicle;

moving said vehicle and said platform with said roof support thereon along said mine face behind said long wall mining machine to a location where said transported roof support is to be positioned;

rotating said turntable and said roof support on said material handling platform 90° about a vertical axis so that the longest dimension of said roof support is perpendicular to said vehicle longitudinal axis and to said mine face;

thereafter removing said transported roof support in said rotated position from said vehicle material handling platform onto the floor of said underground mine so that said longest dimension of said roof support is perpendicular to said mine face; and said transported roof support is removed from said material handling platform by tilting said platform from said substantially horizontal position to permit said roof support to slide off said platform.

2. The method of placing an additional roof support in position adjacent a long wall type mining machine in an underground mine having a mine face comprising:

positioning a roof support to be transported on a substantially horizontal material handling platform of a material transport vehicle, said roof support positioned in a substantially horizontal position on said platform, said material handling platform having a turntable device that enables said roof support on said platform to be rotated horizontally on said platform relative to the longitudinal axis of said vehicle;

positioning said roof support on said platform so that the longest dimension of said roof support is aligned with the longitudinal axis of said vehicle;

moving said vehicle and said platform with said roof support thereon along said mine face behind said long wall mining machine to a location where said transported roof support is to be positioned;

rotating said turntable and said roof support on said material handling platform 90° about a vertical axis so that the longest dimension of said roof support is perpendicular to said vehicle longitudinal axis and to said mine face;

thereafter removing said transported roof support in said rotated position from said vehicle material handling platform onto the floor of said underground mine so that said longest dimension of said roof support is perpendicular to said mine face; and said roof support is positioned on said material handling platform by lowering and tilting said platform and utilizing a cable to slide said roof support onto said platform and thereafter raising said platform to a substantially horizontal position above ground level to a location where said platform and said vehicle are free to move in said mine.

* * * * *